US008424457B2

(12) United States Patent
Baumann et al.

(10) Patent No.: US 8,424,457 B2
(45) Date of Patent: Apr. 23, 2013

(54) SABOT PROJECTILE

(75) Inventors: Christian Baumann, Martinsrieth (DE); Klaus-Dieter Freudenthal, Suderburg (DE); Thomas Heitmann, Unterluess (DE); Michael Vagedes, Hermannsburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 210 days.

(21) Appl. No.: 12/489,591

(22) Filed: Jun. 23, 2009

(65) Prior Publication Data

US 2010/0000439 A1 Jan. 7, 2010

Related U.S. Application Data

(60) Provisional application No. 61/199,832, filed on Nov. 20, 2008.

(30) Foreign Application Priority Data

Jun. 23, 2008 (DE) ..... 10 2008 029 395

(51) Int. Cl.
*F42B 14/06* (2006.01)

(52) U.S. Cl.
USPC ..... 102/522

(58) Field of Classification Search ..... 102/524, 102/529, 501, 520–523
See application file for complete search history.

(56) References Cited

U.S. PATENT DOCUMENTS

| | | | | | |
|---|---|---|---|---|---|
| 4,155,308 | A * | 5/1979 | Murawski | 102/520 |
| 4,505,204 | A * | 3/1985 | Wikstrom | 102/523 |
| 4,850,280 | A * | 7/1989 | Wallow et al. | 102/522 |
| 4,964,342 | A * | 10/1990 | Schleicher | 102/521 |
| H0001412 | H * | 2/1995 | Kline et al. | 102/521 |
| 5,404,816 | A * | 4/1995 | Burri | 102/523 |
| 5,481,981 | A * | 1/1996 | Sippel et al. | 102/522 |
| 6,829,997 | B1 * | 12/2004 | Hilleman | 102/522 |
| 2010/0139518 | A1 * | 6/2010 | Baumann et al. | 102/523 |

FOREIGN PATENT DOCUMENTS

| | | | |
|---|---|---|---|
| DE | 43 30 417 | | 3/1995 |
| FR | 2642161 | A1 * | 7/1990 |
| GB | 2032070 | A * | 4/1980 |

* cited by examiner

*Primary Examiner* — Michael Carone
*Assistant Examiner* — Reginald Tillman, Jr.
(74) *Attorney, Agent, or Firm* — Lucas & Mercanti, LLP; Klaus P. Stoffel

(57) ABSTRACT

A sabot projectile with a subcaliber projectile body and a sabot, which includes a propulsion element that acts on the rear end of the projectile body and a segmented, essentially cylindrical metal guide cage, which is located at the front end of the propulsion element. The guide cage has a central opening that extends in the axial direction, through which the projectile body is passed. So that the sabot projectile is relatively inexpensive to manufacture, has a low weight, and ensures good detachment of the sabot from the projectile body after discharge, the guide cage is a hollow cylinder, on whose inside wall preferably several radial transverse ribs are arranged, which are spaced some distance apart and extend both in the direction of the longitudinal axis of the sabot and in the direction of the projectile body.

14 Claims, 8 Drawing Sheets

SABOT PROJECTILE

The present application claims priority from U.S. Provisional Patent Application No. 61/199,832 filed Nov. 20, 2008, the entire contents of which are incorporated by reference.

BACKGROUND OF THE INVENTION

The invention concerns a sabot projectile with a subcaliber projectile body and a sabot, which comprises a propulsion element that acts on the rear end of the projectile body and a segmented, essentially cylindrical metal guide cage, which is located at the front end of the propulsion element. The guide cage has a central opening that extends in the axial direction, through which the projectile body is passed.

A sabot projectile of this type is disclosed, for example, by DE 43 30 417 C2. It has an essentially hollow cylindrical aluminum guide cage that consists of two segments and that is joined as a single piece with a forward support wall.

One of the disadvantages of this previously known sabot is that the manufacture of the guide cage is relatively expensive.

Especially fiber-reinforced plastics represent an unknown quantity with respect to its material properties in the temperature range of −46° C. to +71° C. and with respect to the enormous rates of load application that act on the plastics during firing.

SUMMARY OF THE INVENTION

The objective of the present invention is to provide a sabot projectile, which is relatively inexpensive to manufacture, has a low weight, and ensures good detachment of the sabot as soon as the sabot projectile has left a corresponding gun barrel after discharge.

The invention is based essentially on the idea that the guide cage consists of a hollow cylinder, on whose inside wall preferably several radial transverse ribs can be arranged, which are spaced some distance apart and extend both in the direction of the longitudinal axis of the sabot and in the direction of the projectile body. Alternatively, the hollow cylinder can be a tube that has been slit open (or two half tubes), which can take on the function of the guide cage.

The transverse ribs stiffen the structure when open and support the guide disk on a smaller diameter during acceleration. The ribs can be closed by partitions at least one predetermined distance from the inside wall of the hollow cylinder, so that several cavities are formed, which surround the central opening and extend in the direction of the longitudinal axis of the sabot. Preferably, the partitions, which are adjacent to the projectile body, can join the ends of the transverse ribs that face the projectile body.

Especially when a light metal is used (for example, an aluminum or magnesium alloy), a guide cage of this type can be manufactured especially inexpensively if it is an extruded profile part that is then subjected to finishing work (for example, the profile is bored) and segmented or even divided in the axial direction. In addition, despite its low weight due to the cavities, the guide cage has sufficient stability and stiffness for the discharge of the corresponding sabot projectile.

It has been found to be advantageous if the guide cage has four or preferably eight chamber-like cavities arranged with uniform distribution around the circumference, wherein the function of the guide cage is ensured even with one (or two) semicircular cavity (cavities), even without transverse ribs.

In a preferred embodiment of the invention, the central opening has an essentially constant inside diameter along the longitudinal axis of the sabot, and this inside diameter corresponds to the maximum outside diameter of the projectile body, i.e., the tailpiece in a tail-piece stabilized projectile. In this regard, the sabot is supported at the front end on the projectile body by means of a segmented support wall, which is made of metal, preferably also a light-metal alloy. The support wall is joined at the front end to the guide cage and extends radially inward.

In another embodiment of the invention, the central opening has a course that tapers towards the front end of the guide cage along the longitudinal axis of the sabot so that the inside diameter of the central opening in the rear-end region of the guide cage corresponds to the maximum outside diameter of the projectile body and so that the guide cage surrounds the projectile body at the front end in a form-locking way.

In an embodiment of this type, a separate support wall can be dispensed with, and instead the end face of the guide cage itself can take on the function of the support wall.

To support the front end of the sabot in a gun barrel, a peripheral guide projection that is directed radially outward can be provided in the front region of the guide cage.

To hold the segments of the guide cage together at the front end, in addition to the use of a strap placed peripherally around the segments, the front end of the guide cage can have an axial projection, which is surrounded by an annular rubber body, which fits into a groove of the axial projection and into a groove of the projectile body.

The basic idea here is thus to break down the function of the previous guide cage into several parts:

- the front guidance of the projectile,
- the axial positioning of this guidance,
- the detachable connection to the pusher plate after discharge and axial clamping of the projectile, and
- trouble-free detachment for the projectile by the use of large exit areas loaded by air pressure.

In a first variant, this can be realized by means of two disks (preferably aluminum) as the front guide, two half profiles (preferably aluminum) for the axial positioning, and two DB-half shells for the detachable connection to the pusher plate. These three half components are bonded, for example, by a two-component adhesive. The projectile is then clamped axially on the pusher plate by the lower edge of the DB-half shells and by means of the clamping elements. The two half shell assemblies in turn are held together at the front by the plastic strap and at the rear by the sealing strip.

Another possibility is presented by extruded profiles. The half shells produced in this way are in turn welded on or, alternatively, bonded, etc., so that the DB half shells can be dispensed with. The welds, etc, are later broken when the projectile leaves the barrel.

To support the clamping of the projectile, a rubber body can be integrated at the front over the two holding shells. The rubber body fits, for example, into a groove of the profiles and a groove of the projectile. Alternatively, however, the rubber body can also be incorporated into the guide half shells instead of the strap of the first variant.

An advantage associated with this solution is that the guide cage becomes inexpensive. Furthermore, it results in very good operation with small amounts of plastic after discharge, for example, in the field. The guide cage is stable with respect to temperature and loading and has a low weight.

Further details and advantages of the invention are apparent from the specific embodiments described below with reference to the drawings.

DETAILED DESCRIPTION OF THE INVENTION

Figure 1:
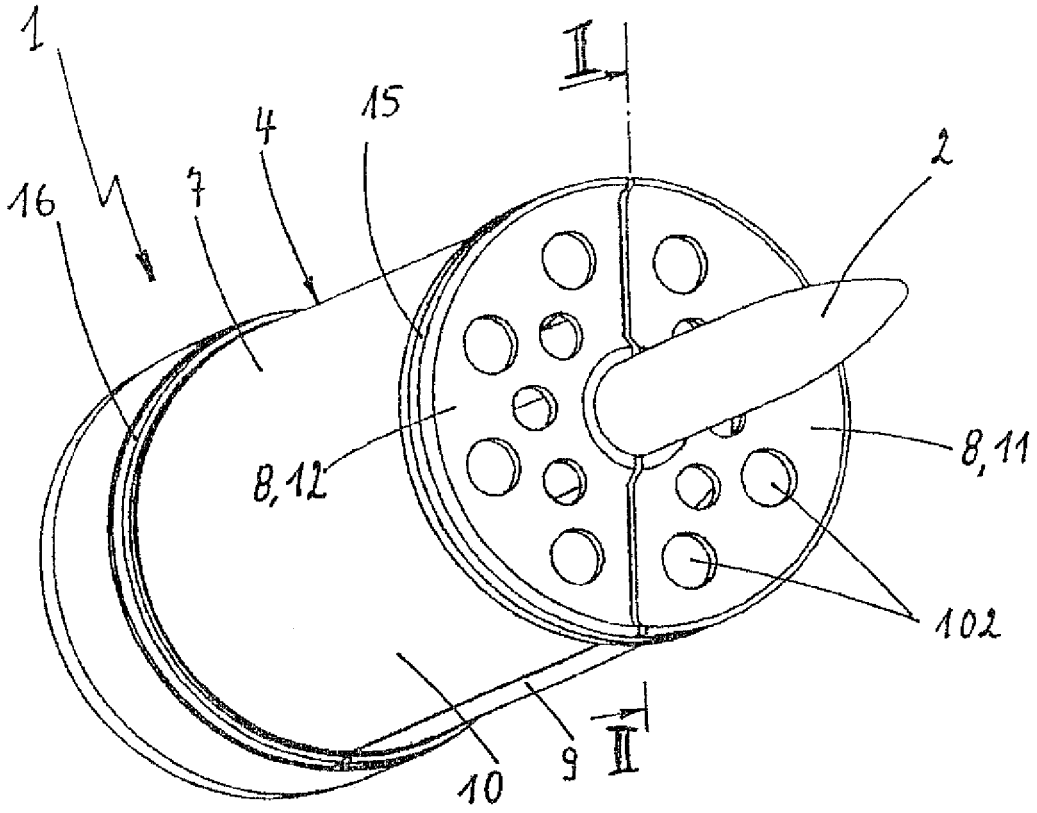
FIG. 1 shows a perspective view of a first embodiment of a sabot projectile according to the invention.
Figure 2:
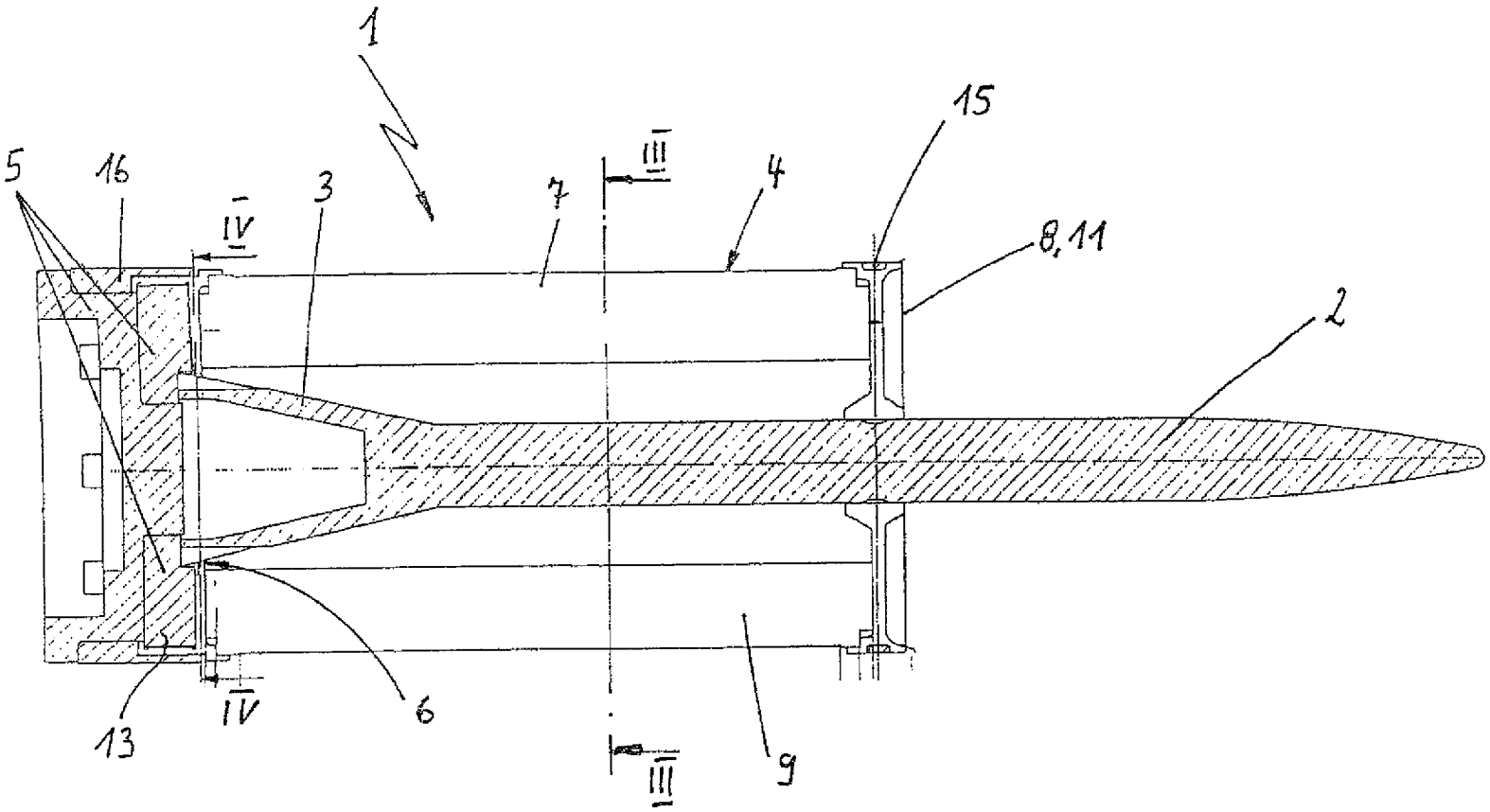
FIG. 2 shows a longitudinal section through the sabot projectile along sectional line II-II in FIG. 1.
Figure 3:
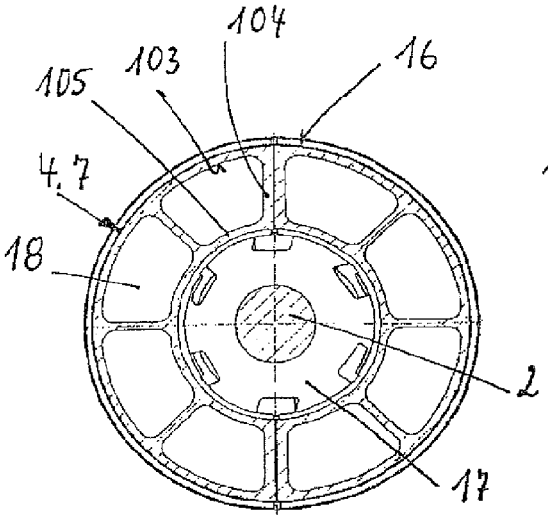
FIGS. 3 and 4 show two cross sections through the sabot projectile along sectional lines III-III and IV-IV in FIG. 2.

FIGS. 1 and 2 show a sabot projectile 1, which comprises a subcaliber projectile body 2 with a conical tail stabilizer 3 and a sabot 4.

The sabot 4 consists essentially of a multisectional propulsion element 5 that acts from the rear on the projectile body 2 (FIG. 2) and is joined with the rear end of the projectile body 2 by a compression joint 6, a cylindrical guide cage 7 connected to the front end of the propulsion element 5, and a support wall 8 with air holes 102, which is located in the front region of the guide cage 7, extends radially inward and supports the projectile body 2.

Figure 4:
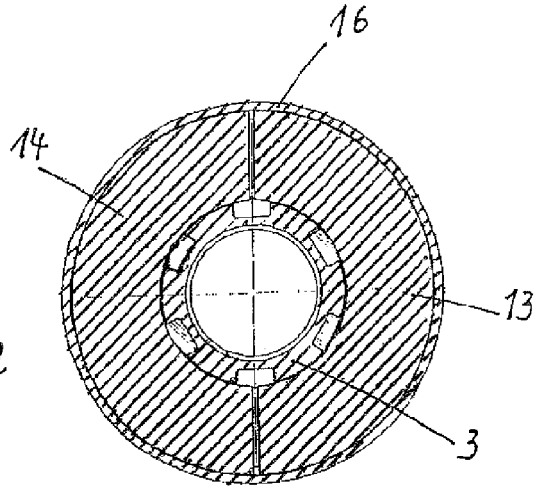

The guide cage 7 consists of two segments 9, 10 in the form of half shells made of an aluminum alloy. The support wall 8, on the other hand, consists of two half disks 11, 12, which can also be made of an aluminum alloy. These half disks 11, 12 are joined with the segments 9, 10 of the guide cage 7, for example, by means of adhesive bonding. The same applies to the joining of two segments 13, 14 (FIG. 4) of the multisectional propulsion element 5 with the rear ends of the segments 9, 10 of the guide cage 7.

The two assemblies of the sabot 4, which consist of the segments 9, 11, and 13 and the segments 10, 12, and 14, are held together at the front by means of a plastic strap 15 and at the rear by a sealing strip 16.

The guide cage 7 is a hollow profile (FIG. 5) produced by extrusion. It has a central opening 17 that extends in the axial direction, through which the projectile body 2 can be passed. It also has eight chamber-like cavities 18 that extend in the direction of the longitudinal axis 100 of the sabot 4 and circumferentially surround the central opening 17. The chamber-like cavities 18 are open at the front end and are closed at the rear end by the elements 13, 14 of the propulsion element 5. Each chamber-like cavity 18 is bounded by the inside wall 103 of the guide cage 7, by two adjacent transverse ribs 104, which extend both in the direction of the longitudinal axis 100 of the sabot 4 and in the direction of the projectile body 2, and by partitions 105, which join the ends of the transverse ribs 104 that face the projectile body 2.

The central opening 17 has an essentially constant inside diameter along the longitudinal axis 100 of the sabot 4, and this inside diameter corresponds to the maximum outside diameter of the conical tail stabilizer 3 of the projectile body 2, so that the projectile body is supported at its front end not by the guide cage 7 but rather only by the support wall 8.

Figure 5:
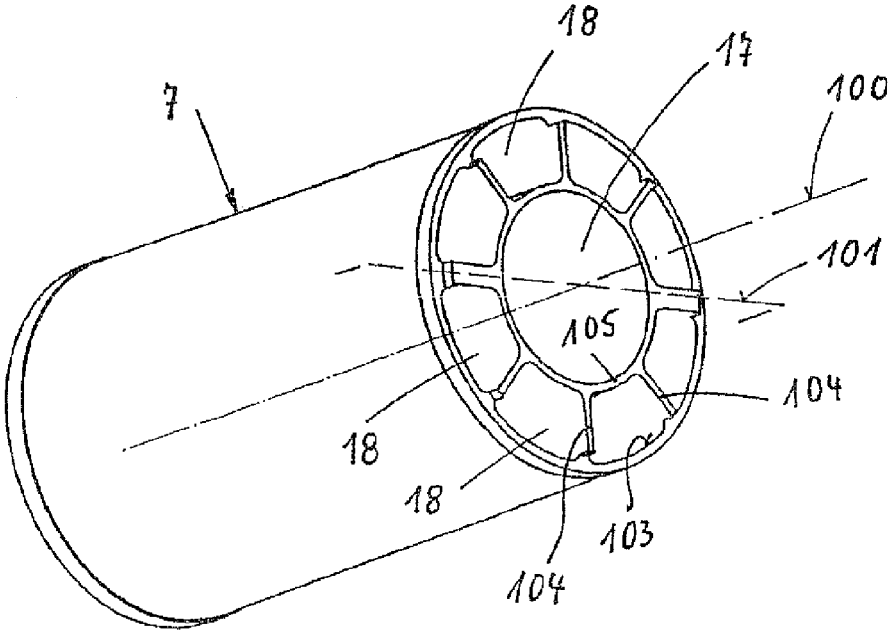
FIG. 5 shows a perspective view of an extruded profile, which is used for producing a guide cage, before segmentation.
Figure 6:
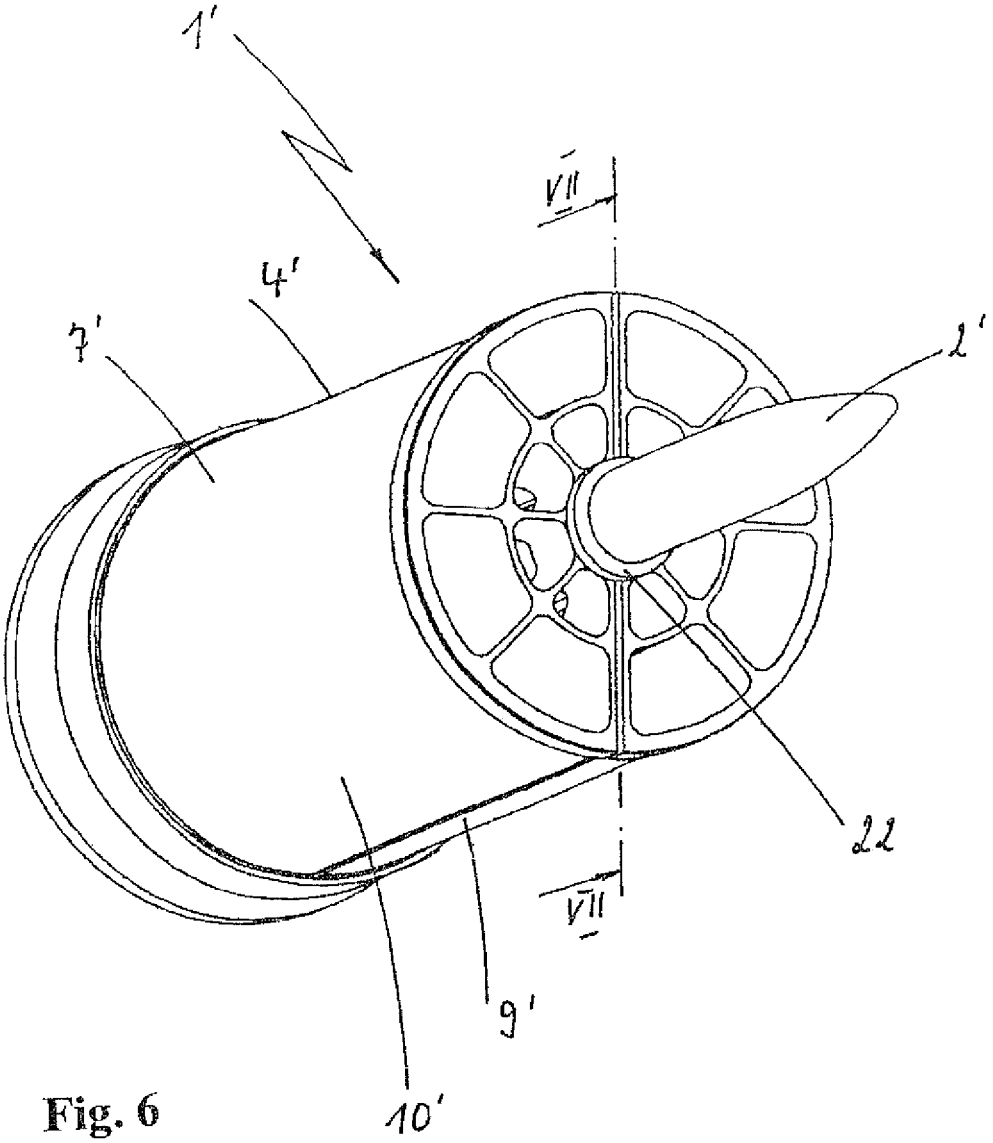
FIG. 6 shows a perspective view of a second embodiment of a sabot projectile according to the invention.
Figure 7:
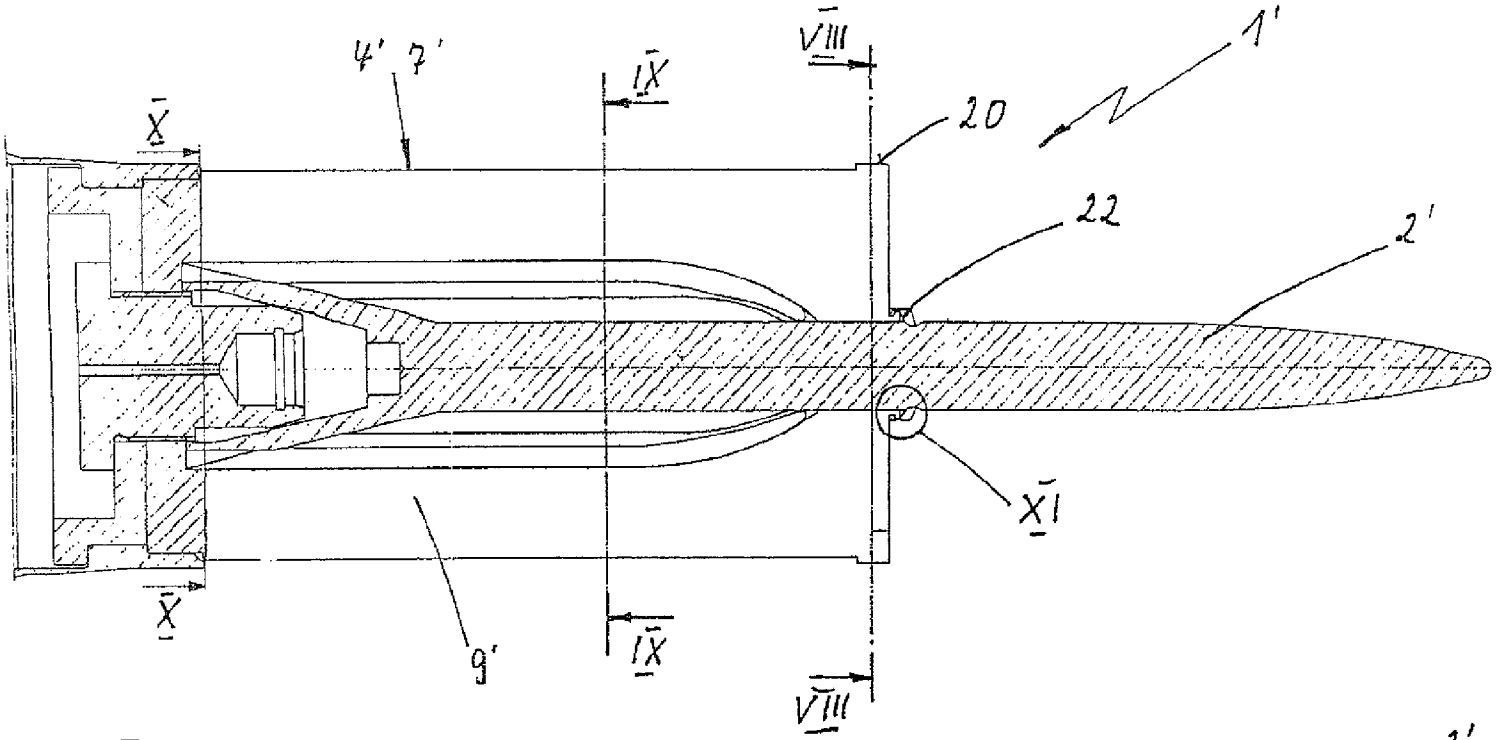
FIG. 7 shows a longitudinal section through the sabot projectile along sectional line VII-VII in FIG. 6.
Figure 11:
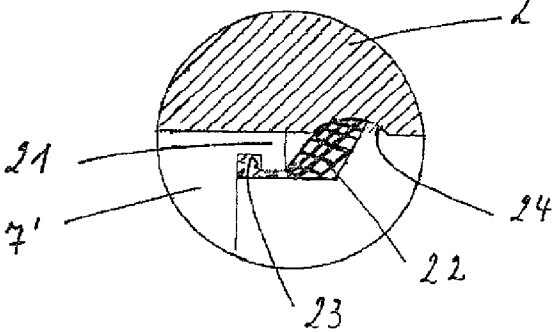
FIG. 11 shows an enlarged view of the region labeled XI in FIG. 7.
Figure 8:
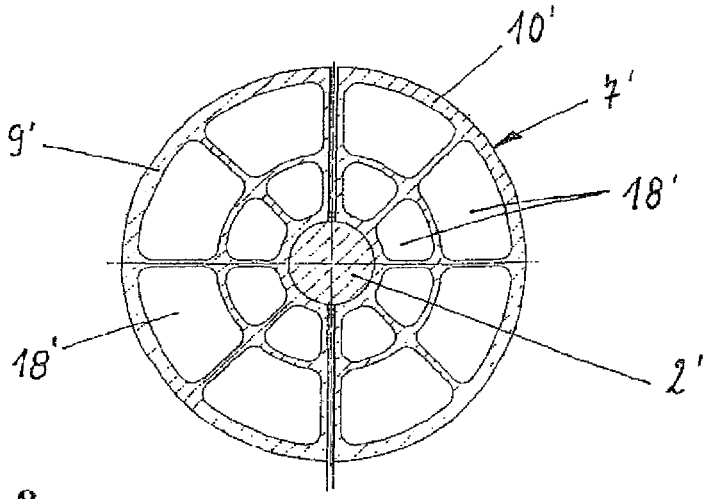
FIGS. 8 to 10 show three cross sections through the sabot projectile along sectional lines VIII-VIII, IX-IX, and X-X in FIG. 7.
Figure 9:
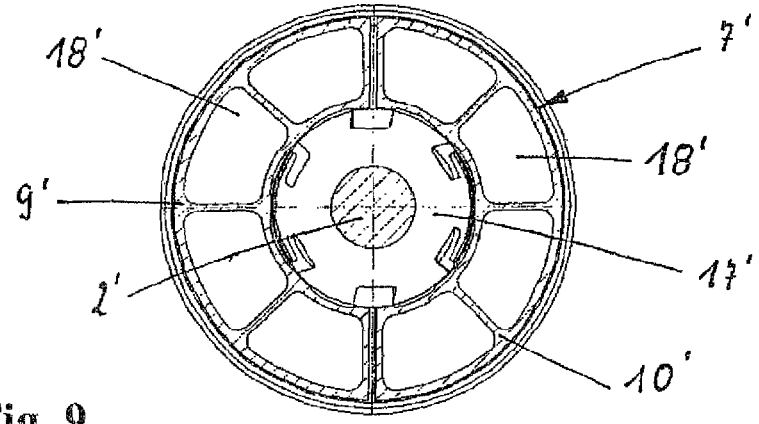
Figure 10:
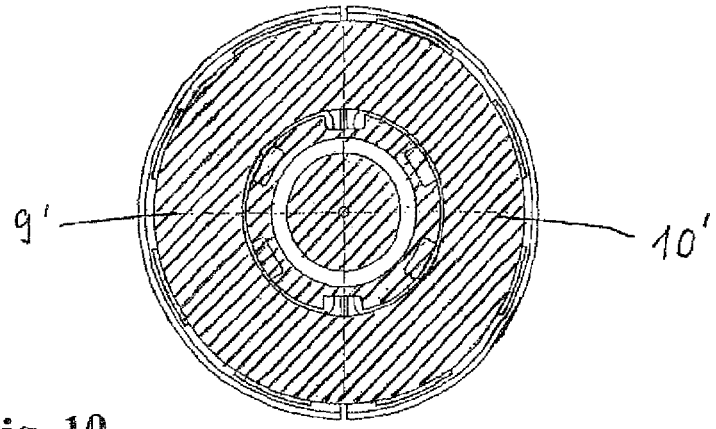
Figure 12:
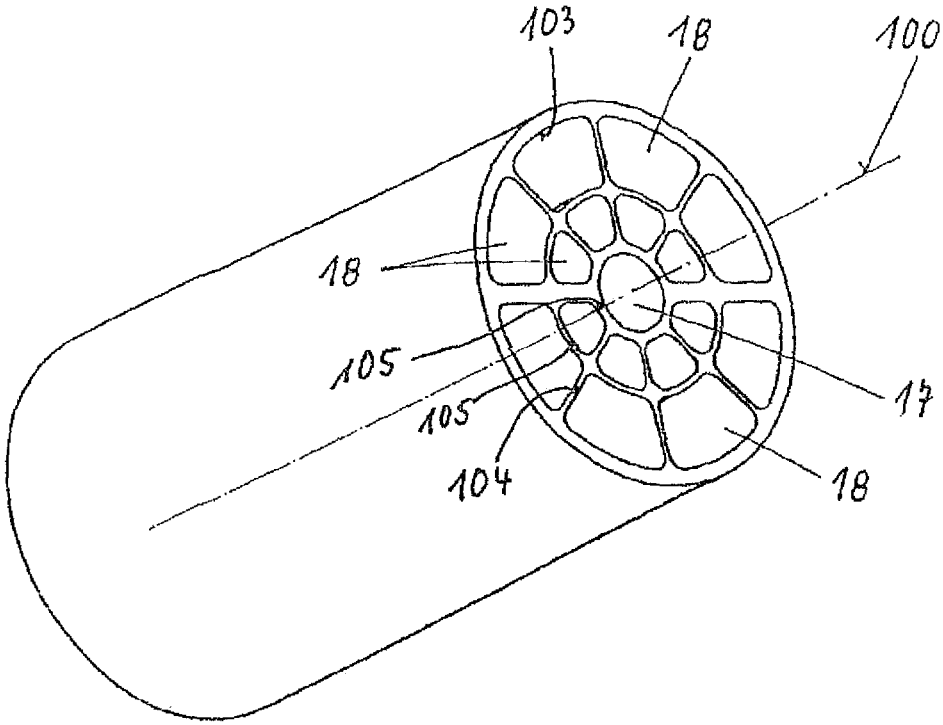
FIG. 12 shows a perspective view of an extruded profile, which is used for producing a guide cage for the second embodiment.

To produce the guide cage 7, a cylindrical tubular profile part with the central opening 17 and the chamber-like cavities 18 is preferably first produced by extrusion. This tubular profile part (FIG. 5) is then finished and divided (segmented) into two segments 9, 10 that extend in the direction of the longitudinal axis 100. The position of the line of separation between the two segments 9, 10 is indicated in FIG. 5 by reference number 101. If necessary, the two segments 9, 10 can then be subjected to one more finishing operation.

Naturally, the guide cage 7 can also be produced, for example, by turning and wire electric discharge machining, but this usually results in higher production costs than the use of extruded profiles.

FIGS. 6 to 12 show a second embodiment of a sabot projectile 1' in accordance with the invention. The reference numerals of elements in this embodiment which correspond to elements in the first embodiment are indicated with a prime. In this embodiment, the central opening 17' has a course that tapers towards the front end of the guide cage 7' along the longitudinal axis 100 of the sabot 4' in such a way that the inside diameter of the central opening 17' in the rear-end region of the guide cage 7' corresponds to the maximum outside diameter of the projectile body 2' (and thus to the conical tail stabilizer) and that the guide cage 7' surrounds the projectile body 2' at the front end in a form-locking way, so that a separate support wall is eliminated in this case.

In this embodiment as well, an extruded profile (FIG. 12), which is preferably formed as a hollow profile, is used to produce the guide cage 7'. The extruded profile can then be bored according to the predetermined course of the central opening 17' and then segmented in the axial direction.

To support the front end of the sabot 4' on the inside wall of a corresponding gun barrel, the front-end region of the guide cage 7' has a peripheral guide projection 20 that is directed radially outward. In addition, the front end of the guide cage 7' has an axial projection 21 (FIG. 11), which is surrounded by an annular body made or an elastic material (preferably rubber) 22, which fits into a groove 23 of the axial projection 21 and into a groove 24 of the projectile body 2' and thus holds the segments 9', 10' of the guide cage 7' together at the front end.

Naturally, the invention is not limited to the embodiments described above. For example, in the case of the first embodiment, the front side of the support wall can also have an axial projection that is surrounded by an annular rubber body that fits into a groove of the axial projection and into a groove of the projectile body.

In addition, the adjacent segments of the functional parts of the sabot (propulsion element, guide cage, support wall) do not necessarily have to be joined with each other by means of adhesive joints, but rather other joining techniques (for example, for producing soldered or welded joints) can also be used, as long as it is guaranteed that these joints will be broken by the forces acting on the functional parts when the respective sabot projectile is fired.

Figure 13:
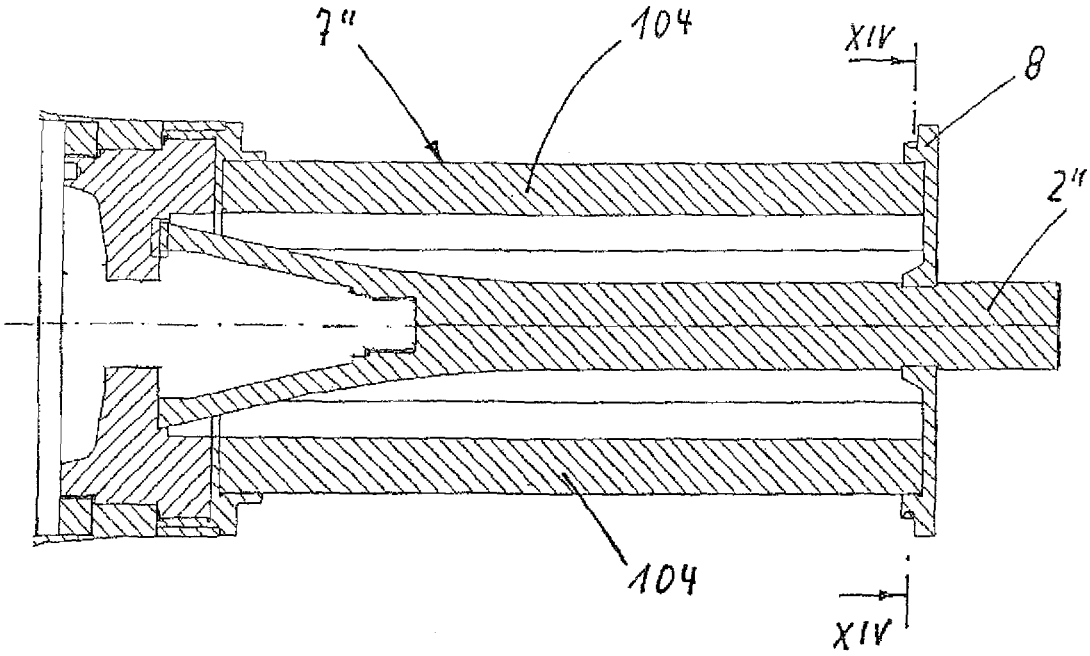
FIGS. 13 and 14 show a longitudinal section and a cross section through a third embodiment of a sabot projectile according to the invention.
Figure 14:
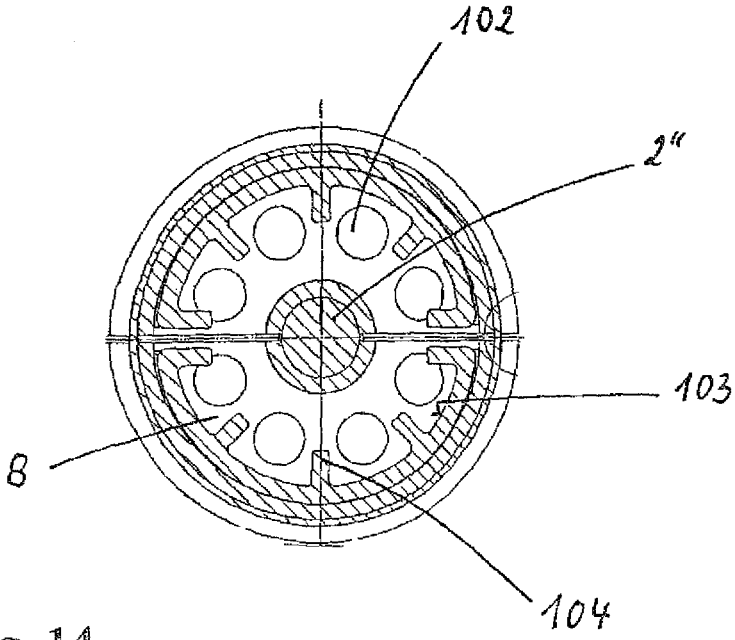

Furthermore, the partitions 105, which join the transverse ribs 104 with each other in the embodiments described above, can also be dispensed with. An embodiment of this type is illustrated in FIGS. 13 and 14.

In this embodiment, the projectile body is labeled with reference number 2", the guide cage with reference number 7", and the support wall with reference number 8. As is apparent especially from FIG. 14, the transverse ribs 104 are again joined as a single piece with the inside wall 103 of the guide cage 7", thereby stiffening it.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A sabot projectile, comprising: a sub-caliber projectile body; and a sabot, the sabot including a propulsion element that acts on a rear end of the projectile body and a segmented, substantially cylindrical metal guide cage, which is located at a front end of the propulsion element, wherein the guide cage has a central opening that extends in an axial direction, through which central opening the projectile body is passed, wherein the guide cage is a hollow cylinder, wherein the guide cage has an inside wall on which a plurality of radial transverse ribs are arranged spaced some distance apart so as to extend both in a direction of a longitudinal axis of the sabot and toward the projectile body, said radial transverse ribs extending substantially for the length of said guide cage, and wherein the transverse ribs are closed by partitions at at least one predetermined distance from the inside wall of the guide cage, so that several chamber-like cavities are formed, which surround the central opening and extend in the direction of the longitudinal axis of the sabot.

2. The sabot projectile in accordance with claim 1, wherein the partitions are adjacent to the projectile body and join ends of the transverse ribs that face the projectile body.

3. The sabot projectile in accordance with claim 1, wherein the chamber-like cavities are arranged with uniform distribution around a circumference of the guide cage.

4. The sabot projectile in accordance with claim 3, wherein the guide cage has eight cavities arranged with uniform distribution around the circumference.

5. The sabot projectile in accordance with claim 1, wherein the central opening has a substantially constant inside diameter along a longitudinal axis of the sabot, said inside diameter corresponding to a maximum outside diameter of the projectile body, and further comprising a metal support wall detachably mounted on a front end of the guide cage, the support wall having air holes and extending radially inward so as to support the projectile body.

6. The sabot projectile in accordance with claim 5, wherein a front end of the support wall has an axial projection, which is surrounded by an annular elastic body that fits into a groove of the axial projection and into a groove in the projectile body.

7. The sabot projectile in accordance with claim 1, wherein the central opening has a course that tapers towards a front end of the guide cage along a longitudinal axis of the sabot so that an inside diameter of the central opening in a rear-end region of the guide cage corresponds to a maximum outside diameter of the projectile body and so that the guide cage surrounds a front end of the projectile body in a form-locking way.

8. The sabot projectile in accordance with claim 7, wherein the front-end region of the guide cage has a peripheral guide projection that is directed radially outward so as to provide front-end support in a gun barrel.

9. The sabot projectile in accordance with claim 7, wherein a front end of the guide cage has an axial projection, which is surrounded by an annular rubber body that fits into a groove of the axial projection and into a groove in the projectile body.

10. The sabot projectile in accordance with claim 1, wherein the guide cage is made of an aluminum or magnesium alloy.

11. The sabot projectile in accordance with claim 1, wherein the guide cage comprises two segments formed as half shells.

12. The sabot projectile in accordance with claim 1, wherein the guide cage is a segmented extruded profile.

13. The sabot projectile in accordance with claim 1, wherein the hollow cylinder is formed by a slit tube or two half tubes.

14. The sabot projectile in accordance with claim 13, wherein the hollow cylinder has transverse ribs.

* * * * *